US011648598B2

(12) United States Patent
Choi

(10) Patent No.: US 11,648,598 B2
(45) Date of Patent: May 16, 2023

(54) CORRUGATED PIPE FORMING APPARATUS

(71) Applicant: DONG-A FLEXIBLE METAL TUBES CO., LTD, Yongin-si (KR)

(72) Inventor: Jinrim Choi, Yongin-si (KR)

(73) Assignee: DONG-A FLEXIBLE METAL TUBES CO., LTD, Yongin-si (KR)

( * ) Notice: Subject to any disclaimer, the term of this patent is extended or adjusted under 35 U.S.C. 154(b) by 0 days.

(21) Appl. No.: 17/541,513

(22) Filed: Dec. 3, 2021

(65) Prior Publication Data

US 2022/0176433 A1 Jun. 9, 2022

(30) Foreign Application Priority Data

Dec. 3, 2020 (KR) ..... 10-2020-0167510

(51) Int. Cl.
*B21D 15/04* (2006.01)

(52) U.S. Cl.
CPC ..... *B21D 15/04* (2013.01)

(58) Field of Classification Search
CPC ..... B21D 15/04; B21D 15/06; B21D 37/18; B21C 37/124; B21C 37/207
USPC ..... 72/77
See application file for complete search history.

(56) References Cited

U.S. PATENT DOCUMENTS 2,309,126 A * 1/1943 Lundius ..... B21K 1/02 72/93
3,183,745 A * 5/1965 Barron ..... B44B 3/001 74/441
3,387,477 A * 6/1968 Shupper ..... B21D 15/04 72/77
3,486,357 A * 12/1969 Raisch ..... B21D 15/06 72/77
3,543,551 A * 12/1970 Falkenberg ..... B21D 15/04 72/119
3,572,074 A * 3/1971 Holdup ..... H01B 13/0009 72/77
3,656,331 A * 4/1972 Kuypers ..... B21D 15/04 72/77
3,788,113 A * 1/1974 Martin ..... B21D 15/06 72/77

FOREIGN PATENT DOCUMENTS

KR 10-2005-0028453 A 3/2005

OTHER PUBLICATIONS

JP 55-165219A, Okabayashi, Dec. 1980.*

* cited by examiner

*Primary Examiner* — Edward T Tolan
(74) *Attorney, Agent, or Firm* — Birch, Stewart, Kolasch & Birch, LLP

(57) ABSTRACT

The present disclosure relates to a corrugated pipe forming apparatus including: a support block rotated by power of a motor; a bearing including an outer ring connected to an inner peripheral surface of the support block and an inner ring; a dies inserted into the inner ring in which at least a portion thereof is disposed inside of the support block, a screw protrusion forming a valley on a surface of the smooth pipe is formed; and a fastening ring. In the support block, a shielding wall covering a first gap formed between the first sidewall of the outer ring and the inner ring is formed to protrude inwardly from the first lateral side, and thus leakage of lubricating oil injected into the bearing is prevented.

17 Claims, 12 Drawing Sheets

CORRUGATED PIPE FORMING APPARATUS

CROSS REFERENCE TO RELATED APPLICATIONS

This non-provisional application claims the benefit under 35 U.S.C. § 119(a) to Patent Application No. 10-2020-0167510, filed in the Republic of Korea on Dec. 3, 2020, which is hereby expressly incorporated by reference into the present application.

BACKGROUND OF THE DISCLOSURE

Field of the Disclosure

The present disclosure relates to a corrugated pipe forming apparatus, and more particularly, to a corrugated pipe forming apparatus in which a surface of a smooth pipe made of metal is pressed inward by a screw protrusion formed on a dies to form a valley on the surface of the smooth pipe.

Related Art

As a device for continuously forming the valleys spaced apart from each other on the surface of a metal smooth pipe, a screw protrusion rotates the ring-shaped dies formed on an inner peripheral surface thereof along the surface of the smooth pipe while linearly moving the smooth pipe at a predetermined speed, and the screw protrusion presses the surface of the smooth pipe inward to continuously form a valley on the surface of the smooth pipe.

The dies is rotatably disposed in a circular opening of a support block installed in a forming barrel rotated by a motor, and the support block is installed movably in a straight line so that the center of the dies can be changed in the molding barrel.

Korean Patent No. 89-002878 discloses an apparatus for continuously forming valleys at regular intervals on the surface of a corrugated metal pipe.

FIG. 10 schematically illustrates a typical metal corrugated pipe forming apparatus in a state in which the center O2 of a ring-shaped dies D formed with a screw protrusion T on an inner peripheral surface is located eccentrically from the center O1 of a smooth pipe 5*a* so that a valley is formed in a smooth pipe 5*a* while the screw protrusion T rotates along the surface of the smooth pipe 5*a*.

When the radius of the inner peripheral surface of the dies D on which the screw protrusion T is formed is set to be twice the radius of the smooth pipe 5*a*, the dies D is rotated by ½ from a predetermined portion of the surface of the smooth pipe, for example, starting at point C and contacting point C again. The forming barrel in which the support block on which the dies is disposed is rotatably built is rotated once around O1 along the trajectory of B.

Accordingly, the bearing interposed between the support block rotated integrally with the forming barrel and the dies rotated along the surface of the smooth pipe is accompanied by a relative rotational movement of an inner ring and an outer ring.

In a typical corrugated pipe forming apparatus, the rotational speed of the forming barrel and the support block is approximately 2000 rpm. When the radius of the inner peripheral surface of the dies is twice the radius of the smooth pipe as described above, the relative rotational speed of the inner ring and the outer ring of the bearing becomes 1000 rpm, and thus high heat is generated between the outer ring and the inner ring due to sliding or rolling friction.

The high heat shortens the life of the bearing and surrounding components.

In addition, the appropriate temperature at which a valley can be efficiently formed while not changing the structure of the corrugated pipe during forming the corrugated pipe is 150° C. to 200° C. Due to the high-speed rotation of the bearing and the high heat generated during work hardening according to the forming of the corrugated pipe, the inside of the forming barrel rises above the above temperature and in severe cases it rises to 300 degrees Celsius or more. Thus, because the structure of the corrugated pipe changes, the strength of the corrugated pipe becomes weak.

Accordingly, in order to reduce the heat generated in the bearing and to allow the inner and outer rings to rotate relatively smoothly, it is necessary to always fill the space between the inner and outer rings with lubricating oil.

However, due to the high-speed rotation of the support block and the relatively high-speed rotation of the inner and outer rings, the lubricating oil leaks through the gap between the inner and outer rings (see the gap 43 shown in FIGS. 5A to 5C) for a short time. Accordingly, it is necessary to stop the operation of the forming apparatus from time to time and re-inject the lubricating oil. Moreover, the leaked lubricating oil is scattered around and the corrugated pipe is contaminated.

In order to address an issue above, a gasket can be disposed to shield the gap between the inner and outer rings, but the gasket is separated from a predetermined position due to the bearing rotating at high speed, and the gasket loses its function due to heat loss.

RELATED ART DOCUMENT

Patent Document (Patent document 1) Korean Patent No. 89-002878, Aug. 8, 1989

SUMMARY OF THE DISCLOSURE

An aspect of the present disclosure is directed to providing an apparatus capable of continuously forming a high-quality corrugated pipe by preventing leakage of the lubricant oil injected into a bearing.

Another aspect of the present disclosure is directed to providing a corrugated pipe forming apparatus capable of preventing damage and heat loss of the bearing and surrounding elements by reducing the generation of heat accompanied by rolling friction of the bearing and extending the lifespan.

Another aspect of the present disclosure is directed to providing an apparatus capable of forming a corrugated pipe of always constant quality by improving the formability of organically coupled rotating components.

The aspects of the present disclosure are not limited to those mentioned above, and other aspects not mentioned herein will be clearly understood by those skilled in the art from the following description.

A corrugated pipe forming apparatus according to an embodiment of the present disclosure includes: a support block rotated by power of a motor, in which a circular opening is formed therein; a bearing including an outer ring fixedly connected to an inner peripheral surface of the support block and an inner ring disposed to rotate relative to the outer ring; a dies disposed in the circular opening of the support block, in which a circular hole is formed through which a smooth pipe enters, a screw protrusion forming a valley on a surface of the smooth pipe is formed on the inner peripheral surface, and at least a portion thereof is inserted into an inner ring and connected to the inner ring; and a fastening ring disposed to face the dies in the circular opening of the support block and connected to the dies, wherein the support block has a shielding wall formed to protrude toward the fastening ring on a first lateral side, and the shielding wall is formed to cover a first gap formed between a first sidewall of the outer ring and a first sidewall of the inner ring.

The fastening ring may be disposed to face the dies based on the bearing to be fastened to the dies.

In addition, the corrugated pipe forming apparatus further includes a forming barrel connected to a power transmission device for transmitting power of a motor and having a space formed therein, wherein the support block may be disposed in the space of the forming barrel, a screw rod may be connected movably to the forming barrel, and the support block may be disposed to be movable in a straight line within the space by the screw rod.

In addition, the shielding wall may protrude radially inward toward the center of the circular opening to cover the entire first sidewall of the outer ring and a portion of the first sidewall of the inner ring.

In addition, the shielding wall includes a first shielding portion covering the first sidewall of the outer ring and the first gap, and a second shielding portion covering a portion of the first sidewall of the inner ring, wherein the second shielding portion may be formed to have a smaller front and rear width than the first shielding portion, and may be disposed to be spaced apart from the first sidewall of the inner ring.

In addition, the second shielding portion may cover ½ of a radial width of the first sidewall of the inner ring from an outer peripheral surface of the inner ring toward a radially inner side.

In addition, the fastening ring includes a boss portion inserted into an inner side of the first sidewall of the inner ring, and an outwardly protrusion rim extending in a radially outward direction from the boss portion, wherein the outwardly protrusion rim may be in close contact with a portion of the first sidewall of the inner ring.

In addition, the corrugated pipe forming apparatus may further include a side cover fastened to a second lateral side opposite to the first lateral side of the support block and having an opening hole formed therein so that a front surface of the dies is exposed.

In addition, the inner and outer rings may be disposed such that a second sidewall opposite the first sidewall enters from a surface of the second lateral side of the support block toward a first lateral side of the support block, and the side cover may be formed to cover a second gap formed on the second sidewall of the inner and outer rings to shield them.

In addition, the side cover may include a plate body covering a surface of the second lateral side of the support block, and an inner protrusion rim extending radially inwardly from the plate body toward the opening hole and protruding toward the inner and outer rings to shield a second gap formed between second sidewalls of the inner and outer rings.

In addition, the inner protrusion rim may protrude radially inwardly so as to cover the entire second sidewall of the outer ring and a portion of the second sidewall of the inner ring.

In addition, the inner protrusion rim may protrude to cover ½ of a radial width from an outer peripheral surface of the second sidewall of the inner ring.

In addition, the inner protrusion rim is in contact with the second sidewall of the outer ring, and the inner protrusion rim is formed so that a rear surface of an inner edge enters more forward than other parts of the inner protrusion rim, so that the inner edge is spaced apart from the inner ring.

In addition, the dies includes a core portion inserted into an inner ring and a flange portion extending radially outward from the core portion, and a part of the second sidewall of the inner ring not covered by the inner protrusion rim is in close contact with the flange portion of the dies.

In addition, the forming barrel is formed with a through hole connecting the space of the forming barrel and an external space, so that heat generated during forming of the corrugated pipe may be radiated to an outside through the through hole.

According to various embodiments of the present disclosure, the present disclosure has the following advantages.

First, the shielding wall formed on the first lateral side of the support block shields the first gap formed on the first sidewall of the bearing, and the side cover fastened to the second lateral side of the support block shields the second gap formed on the second sidewall of the bearing. Hence, the lubricating oil injected into the bearing does not leak even when the bearing rotates at high speed, so the corrugated pipe can be continuously manufactured without the need to frequently inject high-concentration lubricating oil such as grease into the bearing.

Second, since leakage of the lubricating oil injected into the bearing is prevented, the frictional heat between the inner and outer rings is reduced, and the frictional heat between the screw protrusion of the dies forming a corrugation and the surface of the smooth pipe is reduced, and thus age hardening is also reduced. Hence, it is possible to manufacture a high-quality corrugated pipe without changing the metal structure as well as extending the life of each component.

Third, the formability of the rotating dies, the fastening ring, and the support block is improved, so that it is possible to always provide a corrugated pipe of uniform quality.

Fourth, heat is radiated through the through hole formed in the forming pipe, so that the corrugated pipe can always be formed under an appropriate temperature condition.

The advantages of the present disclosure are not limited to those mentioned above, and other advantages not mentioned herein will be clearly understood by those skilled in the art from the following description.

BRIEF DESCRIPTION OF THE DRAWINGS

FIG. 5A is a front view of the support block. FIG. 5B is a rear view of the support block. FIG. 5C is a cross-sectional view taken along line A-A of FIG. 5B.

DESCRIPTION OF EXEMPLARY EMBODIMENTS

Figure 1:
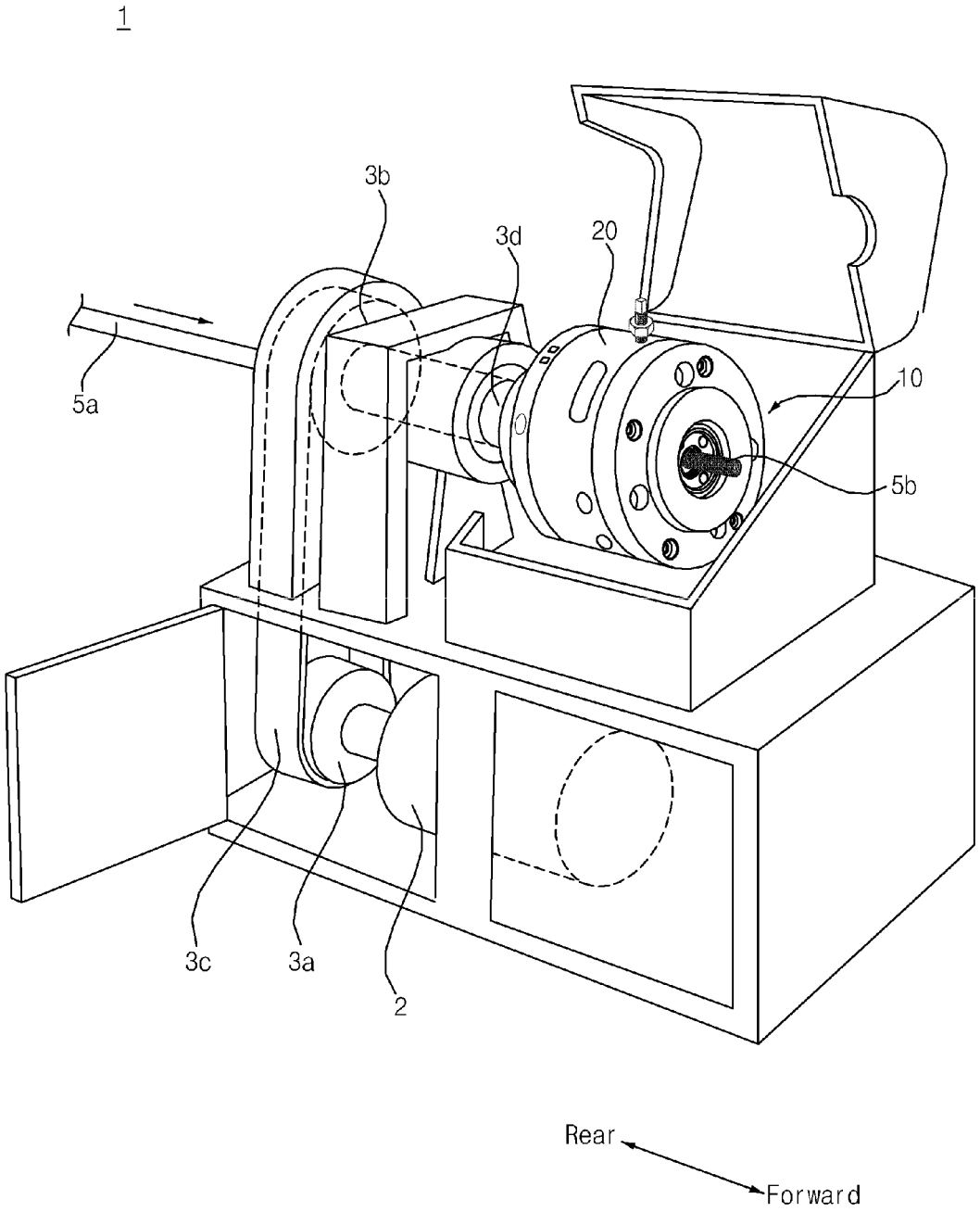
FIG. 1 is a perspective view showing a corrugated pipe forming machine including a corrugated pipe forming apparatus according to an embodiment of the present disclosure.

Advantages, features, and methods of accomplishing the same of the present disclosure will become apparent with reference to embodiments described in detail below together with the accompanying drawings. However, the present disclosure is not limited by embodiments disclosed hereinafter, and may be implemented in various forms. Rather, these embodiments are provided to so that this disclosure will be through and complete and will fully convey the scope of the present disclosure to those skilled in the technical field to which the present disclosure pertains, and the present disclosure will only be defined by the appended claims. Like reference numerals refer to like elements throughout the specification.

Hereinafter, a corrugated pipe forming apparatus according to embodiments of the present disclosure will be described with reference to the accompanying drawings.

FIG. 1 is a schematic representation of a corrugated pipe forming machine including a corrugated pipe forming apparatus according to an embodiment of the present disclosure.

Referring to FIG. 1, the corrugated pipe forming machine 1 includes a motor 2 for generating a rotational force, a power transmission devices 3*a* to 3*d* for transmitting power generated from the motor 2, and a corrugated pipe forming apparatus 10 which is rotated by receiving power from the power transmission devices 3*a* to 3*d*.

The power transmission devices 3*a* to 3*d* include a first pulley 3*a* connected to a rotation shaft of the motor 2, a second pulley 3*b* spaced apart from the first pulley 3*a*, a belt 3*c* connecting the first pulley 3*a* and the second pulley 3*b*, and a power transmission shaft 3*d* connected to a forming barrel 20 of the corrugated pipe forming apparatus and the second pulley 3*b*.

In this embodiment, a pulley mechanism has been described as an example as the power transmission device, but a known power transmission device such as a gear train may be used.

The smooth pipe 5*a* is transferred in a straight line at a constant speed by a known transfer mechanism (not shown) toward the space formed inside the forming barrel 20, the smooth pipe 5*a* is continuously formed with a valley on its surface in the forming barrel, and the corrugated pipe 5*b* in which the valley is formed continues to advance at a constant speed.

A known corrugated pipe support device (not shown) or a guide device (not shown) may be disposed after the forming barrel so that the corrugated pipe 5*b* may be continuously transferred without being bent after being formed.

Figure 2:
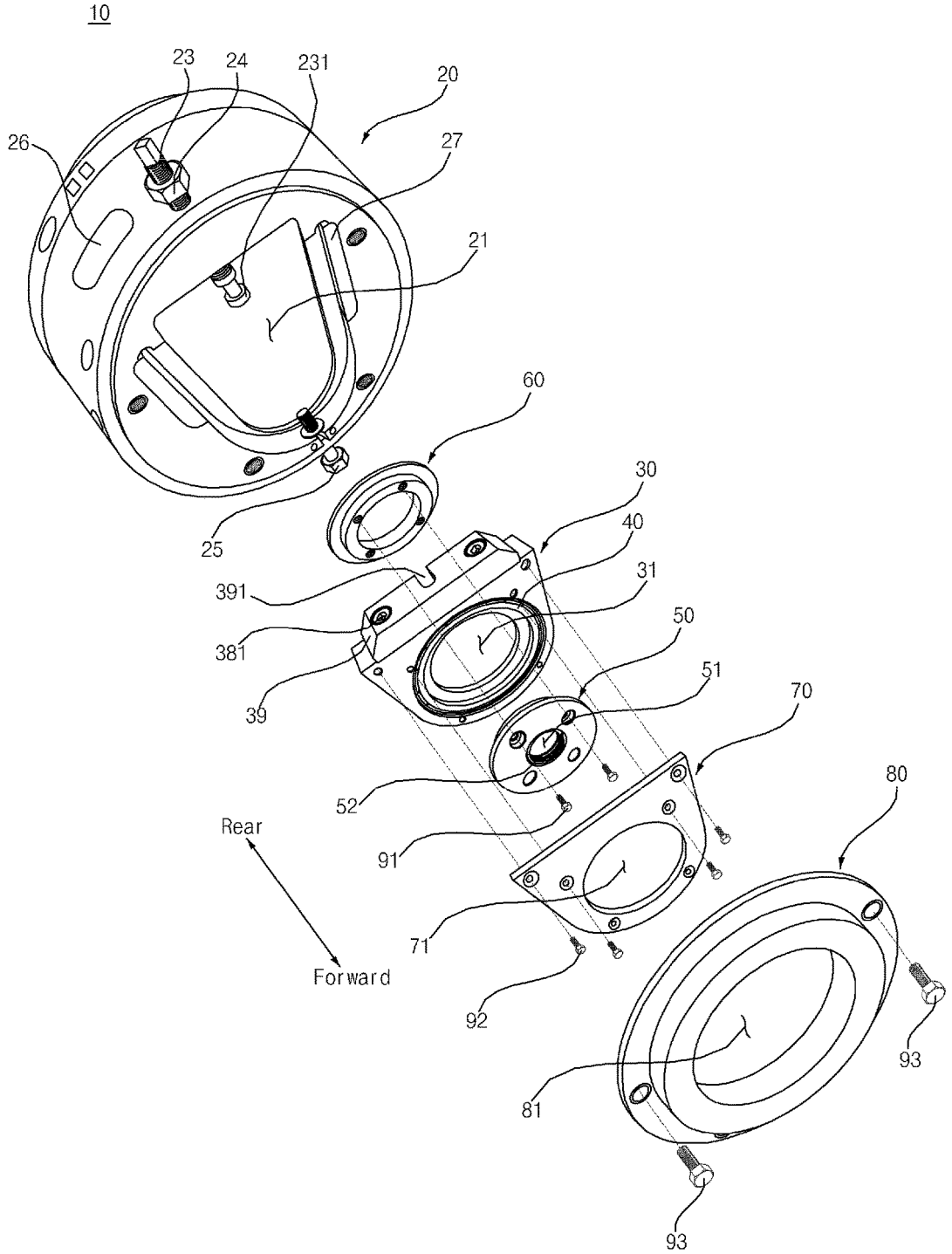
FIG. 2 is an exploded perspective view of a corrugated pipe forming apparatus according to an embodiment of the present disclosure.
Figure 3:
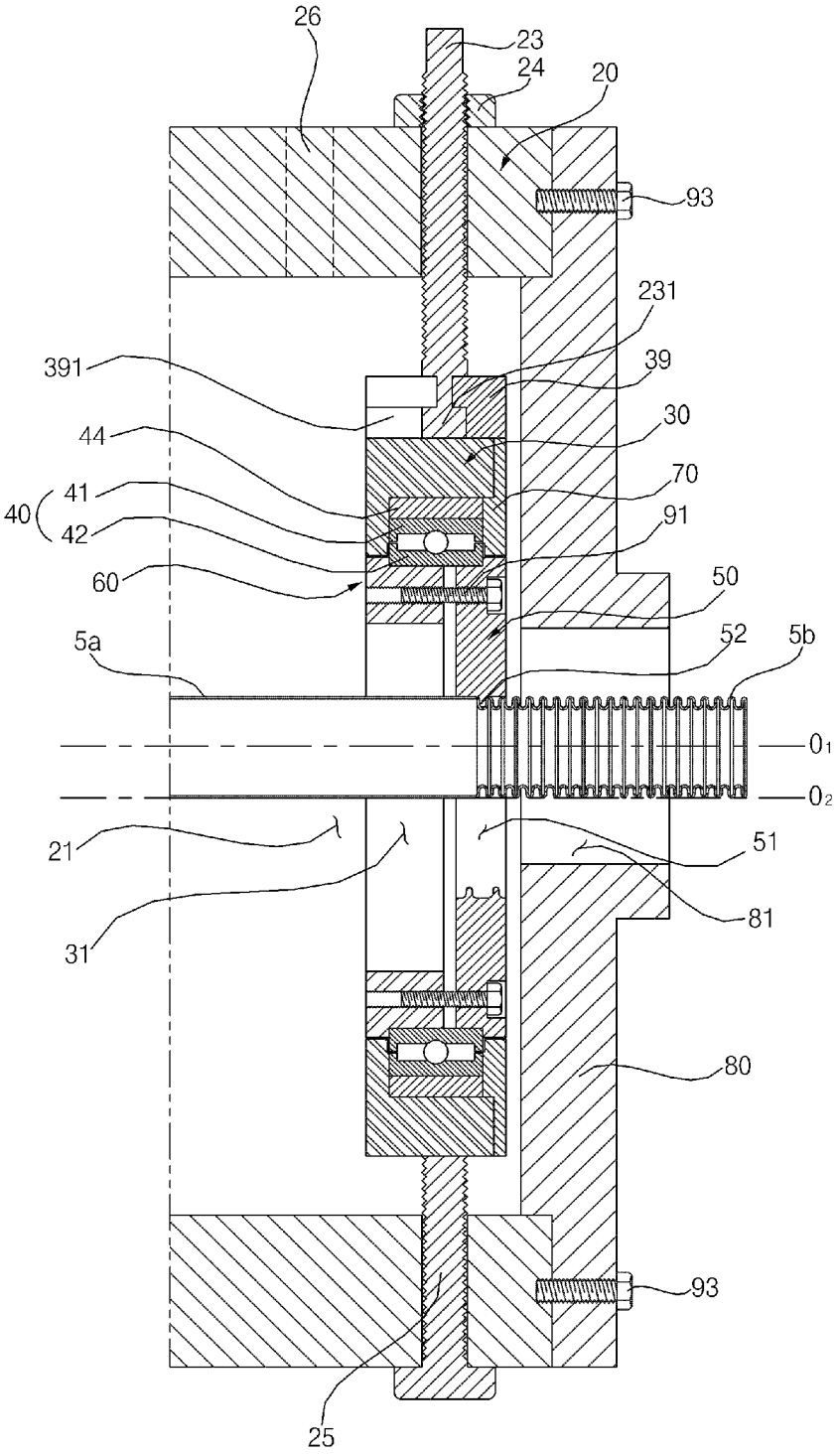
FIG. 3 is a cross-sectional view of a corrugated pipe forming apparatus according to an embodiment of the present disclosure.

FIG. 2 is an exploded perspective view of a corrugated pipe forming apparatus 10 according to an embodiment of the present disclosure, and FIG. 3 is a partially assembled cross-sectional view of FIG. 2.

Referring to FIGS. 2 and 3, the corrugated pipe forming apparatus 10 according to an embodiment of the present disclosure includes the forming barrel 20 which is connected to the aforementioned power transmission shaft 3*d* and rotates when a motor is operated, the support block 30 disposed so as to be movable in a vertical direction in a space 21 formed in the forming barrel 20, the bearing 40 disposed on the inner side of the inner peripheral surface of the support block 30, and a dies 50 having at least a portion thereof inserted into the bearing 40 to form a valley on a surface of the smooth pipe 5*a*.

The dies 50 has a circular hole 51 into which the smooth pipe 5*a* enters, and a screw protrusion 52 is formed to protrude inward on the inner peripheral surface forming the circular hole 51, thus forming a valley on a surface of the smooth pipe 5*a* entered into the circular hole 51.

Based on the bearing 40 disposed on the inner side of the inner peripheral surface of the support block 30, the fastening ring 60 is disposed to face the dies 50.

The fastening ring 60 is fastened with a known fastening portion, for example, a bolt 91 so that at least a portion thereof is inserted into the bearing 40 and fixed to the dies 50.

In the forming barrel 20, the upper and lower screw rods 23 and 25 are disposed to penetrate toward the support block 30. In the initial state, by adjusting the upper and lower screw rods 23 and 25 to adjust the upper and lower positions of the support block 30, the position of the dies 50 may be set so that the screw protrusion 52 formed on the dies 50 presses the surface of the smooth pipe 5*a* inward to form a valley in the smooth pipe 5*a*.

The forming barrel cover 80 is fastened to the front surface of the forming barrel 20 with bolts 93.

Referring to FIG. 3, the forming barrel 20 is disposed to rotate about the central axis O1 of the smooth pipe 5*a* or the corrugated pipe 5*b*, and the support block 30 and the dies 50 are disposed so that the eccentric axis O2 spaced a predetermined distance from the central axis O1 becomes the center so that the support block 30 and the dies 50 may be rotated so that the eccentric axis O2 of the dies 50 and the support block 30 rotate around the central axis O1 as the center.

A through hole 26 is formed in the forming barrel 20 to communicate the external space and the space 21 inside the forming barrel 20, so that high heat generated during corrugated pipe forming may be discharged to the outside through the through hole 26. Accordingly, heat generated during corrugated pipe forming is radiated to an outside to prevent the structure of the corrugated pipe from being deteriorated.

Figure 4:
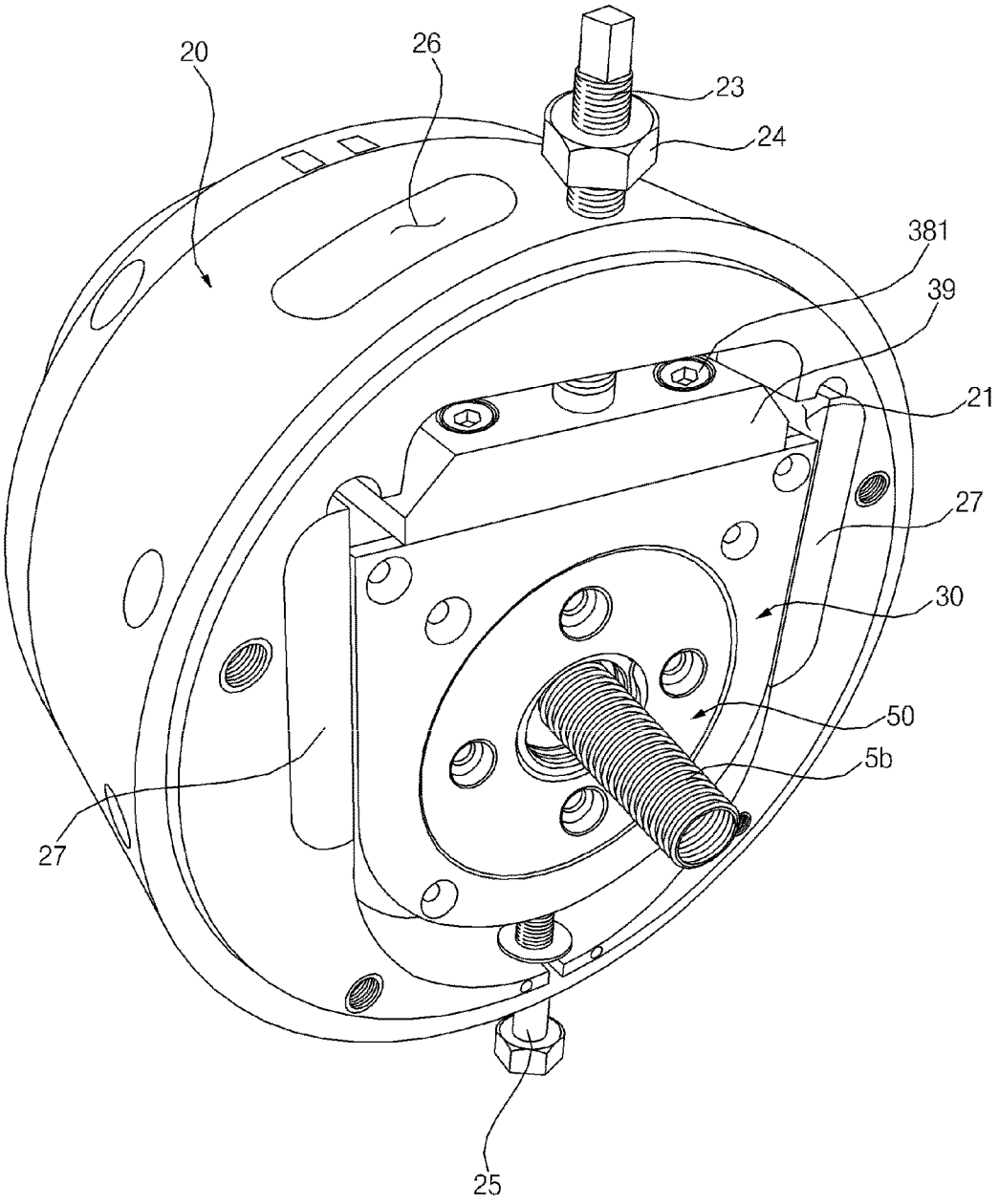
FIG. 4 is a perspective view in which a forming barrel cover is omitted from the corrugated pipe forming apparatus according to an embodiment of the present disclosure.

FIG. 4 is a perspective view in which the support block 30 and the dies 50 are assembled to the forming barrel 20. Referring to FIGS. 3 and 4, the support block 30 is disposed in the space 21 of the forming barrel 20 so as to be movable up and down while being guided by a pair of guiders 27 formed to be spaced apart from each other inside the forming barrel 20, and the header 39 may be fixed to the upper side of the support block 30 with a fastening screw 381.

The header 39 may be formed integrally with the support block 30.

The upper screw rod 23 may be screwed to the upper side of the forming barrel 20, the lower screw rod 25 may be screwed to the lower side, and a groove 391 with one side cut out is formed in the header 39, and the end 231 of the upper screw rod 23 may be inserted into the groove 391.

Accordingly, when the upper and lower screw rods 23 and 25 are rotated, the support block 30 is moved in the up and down directions, the support block 30 is moved to a predetermined position, and then the nut 24 is fastened. Then, the support block 30 is fixed at a predetermined position within the space 21 of the forming barrel 20.

Figure 5A:
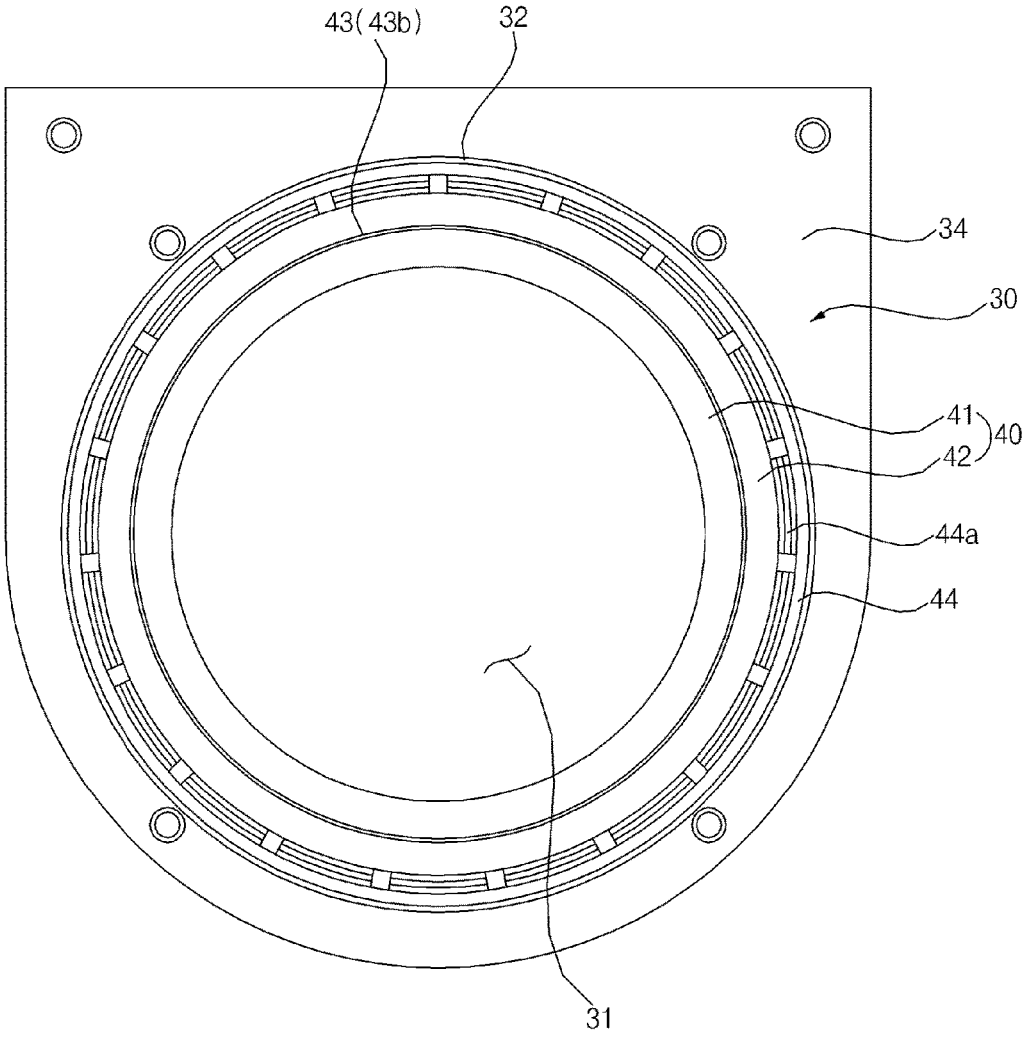
FIGS. 5A-5C are views showing a support block included in the corrugated pipe forming apparatus according to an embodiment of the present disclosure.
Figure 5B:
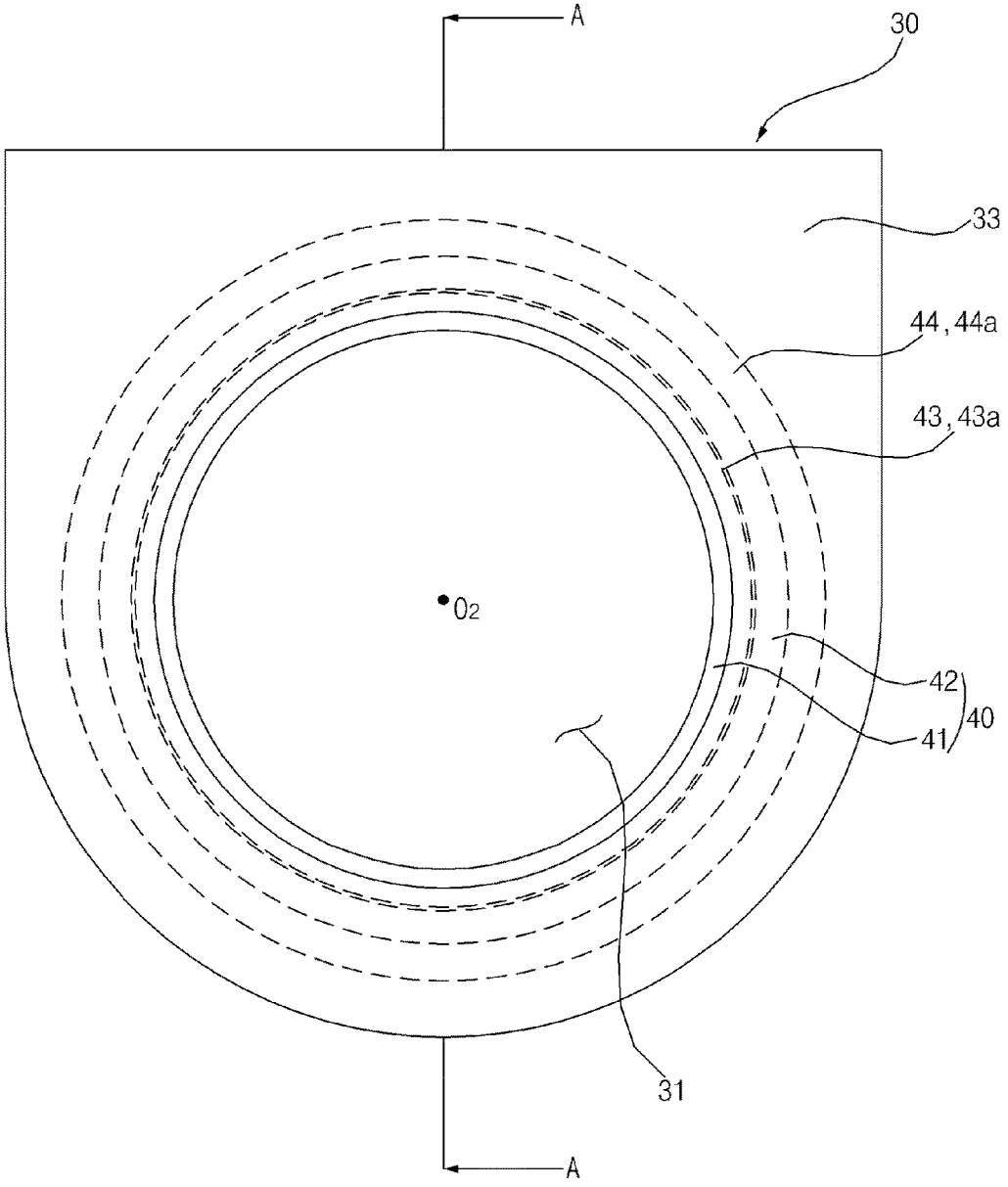
Figure 5C:
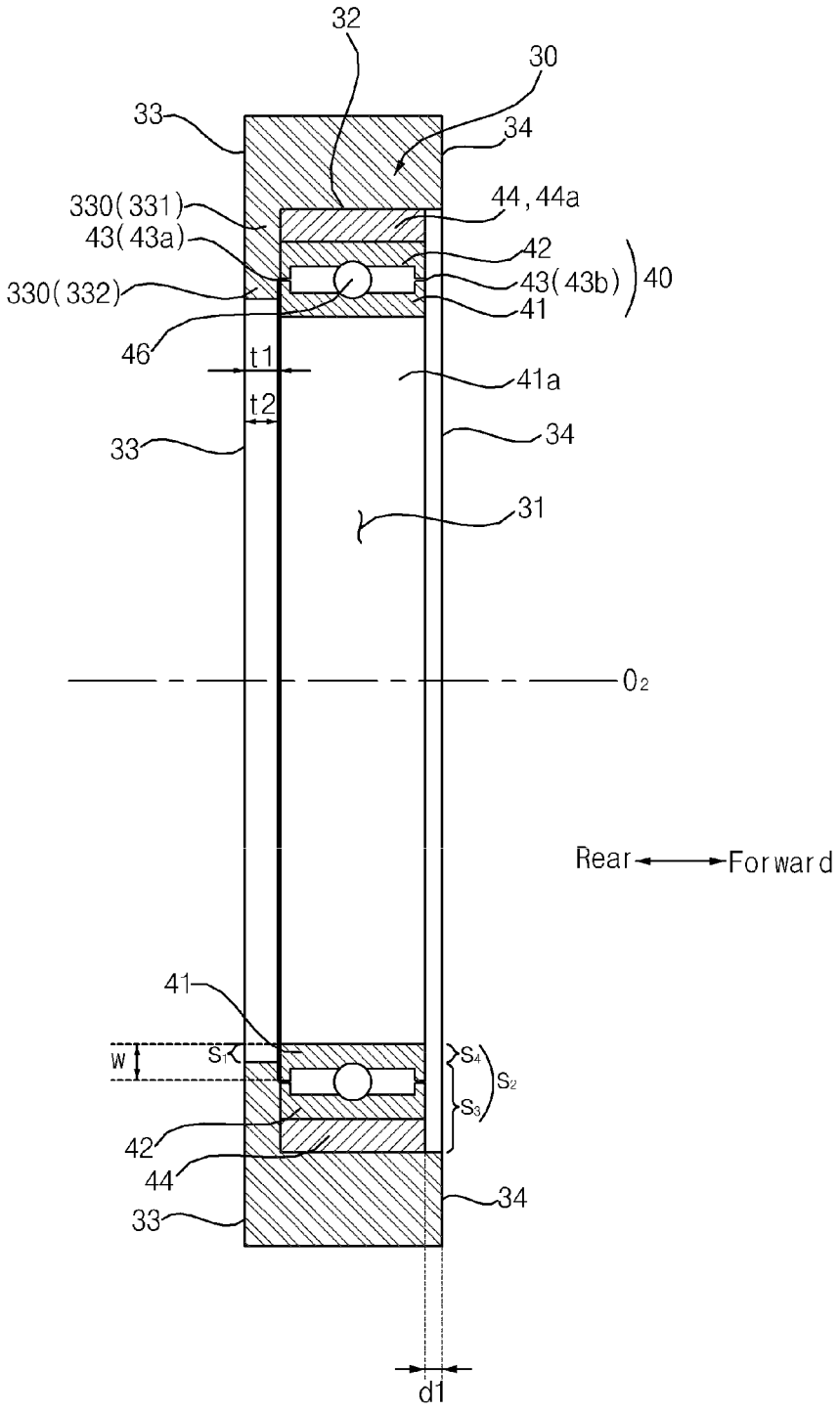

5A is a front view of the support block 30 in which the header is omitted and the bearing 40 is coupled, FIG. 5B is a rear view of the support block 30, and FIG. 5C is a cross-sectional view taken along line A-A of FIG. 5B.

The support block 30 has a circular opening 31 formed therein, and a ring-shaped bearing 40 is disposed inside the inner peripheral surface 32 of the support block 30 forming the circular opening 31. The bearing 40 may include an outer ring 42 and an inner ring 41, and a ball 46 (see FIG. 5C) or a roller may be disposed between the inner and outer rings. The bearing 40 may include a retainer for disposing the ball 46 at a predetermined position, but the illustration thereof is omitted here.

Referring to FIGS. 5A and 5C, the support block 30 has a fixing ring 44 and a bridge 44*a* for fixing the bearing 40 in the inner side of the inner peripheral surface 32 fixedly disposed, and the outer ring 42 is fixed to the inside of the bridge 44*a*.

Hereinafter, the bridge 44*a* will be described as a component included in the fixing ring 44. The bridge 44*a* may be omitted from the above.

An inner ring 41 is disposed inside the outer ring 42 to be rotatable relative to the outer ring 42, and an annular gap 43 is formed between the inner and outer rings 41 and 42.

The gap 43 includes a first annular gap 43*a* formed in a first sidewall of the inner and outer rings 41 and 42 and a second annular gap 43*b* formed in a second sidewall opposite to the first sidewall.

Accordingly, when the inner and outer rings 41 and 42 are rotated relative to each other, the lubricating oil injected into an inner space of the inner and outer rings may leak to the outside of the bearing through the gap 43.

Referring to FIGS. 5B and 5C, the support block 30 is formed with a shielding wall 330 protruding radially inward toward the center O2 of the circular opening 31 on a first lateral side 33 so that the first gap 43*a* is covered so as to be shielded.

The shielding wall 330 may include a first shielding portion 331 covering a first lateral side of the fixing ring 44, the entire first sidewall of the outer ring 42, and the first gap 43*a*, and a second shielding portion 332 covering a portion of the first sidewall of the inner ring 41.

It is preferable that the second shielding portion 332 protrudes toward the inner side of the inner ring 41 to cover up to a part corresponding to ½ of the width W1 in the radial direction of the first sidewall.

The front and rear widths of the first and second shielding portions 331 and 332 may be formed identically, and the front and rear widths t1 of the first shielding portion 331 are formed to be larger than front and rear widths t2 of the second shielding portion 332, so that the first sidewall of the outer ring 42 is in close contact with the first shielding portion 331, and the first sidewall of the inner ring 41 is spaced apart from the second shielding portion 332, and thus the inner ring 41 may be rotated without interference of the shielding wall 330.

In the annular space S1 formed between the inner peripheral surface of the inner ring 41 from the inner peripheral surface of the shielding wall 330, the outwardly protrusion rim 64 of the fastening ring to be described later is positioned.

The second lateral side of the fixing ring 44 and the second sidewall of each of the inner and outer rings 41 and 42 are disposed to enter a predetermined distance dl from the surface of the second lateral side 34 of the support block 30 toward the rear where the first lateral side 33 is positioned, so that a second annular space S2 is formed between the inner peripheral surface 32 of the support block 30 and the inner peripheral surface of the inner ring 41.

In the second annular space S2, a 2-1 annular space S3 located between the inner peripheral surface 32 of the support block 30 and a portion of the second sidewall of the inner ring 41 is covered by a side cover 70 to be described later, and the second gap 43*b* formed in the second sidewall of the inner rings 41 and 42 is shielded.

The flange portion 54 of the dies, which will be described later, is located in the remaining annular space S4 located inside the radius of the second annular space S2.

Figure 6:
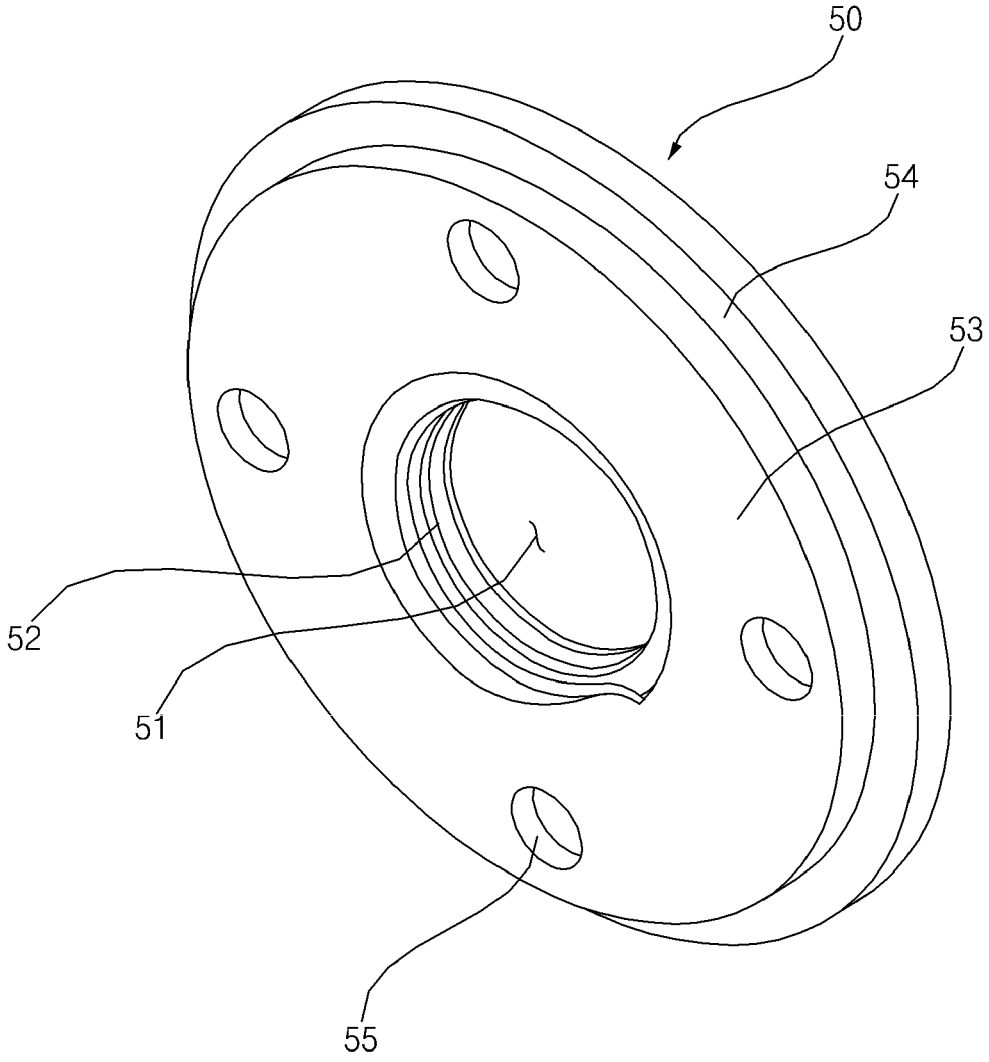
FIG. 6 is a perspective view of a dies included in the corrugated pipe forming apparatus according to an embodiment of the present disclosure.
Figure 7:
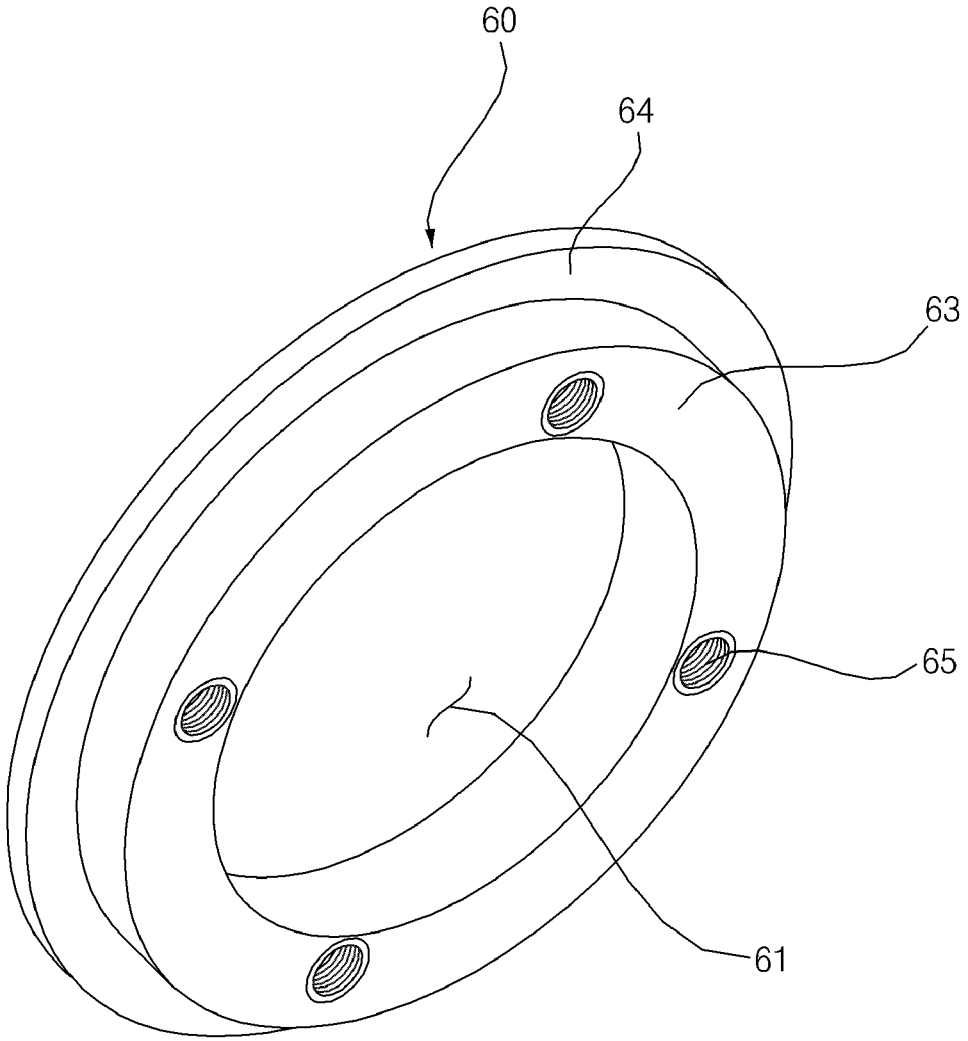
FIG. 7 is a perspective view of a fastening ring included in the corrugated pipe forming apparatus according to an embodiment of the present disclosure.
Figure 8:
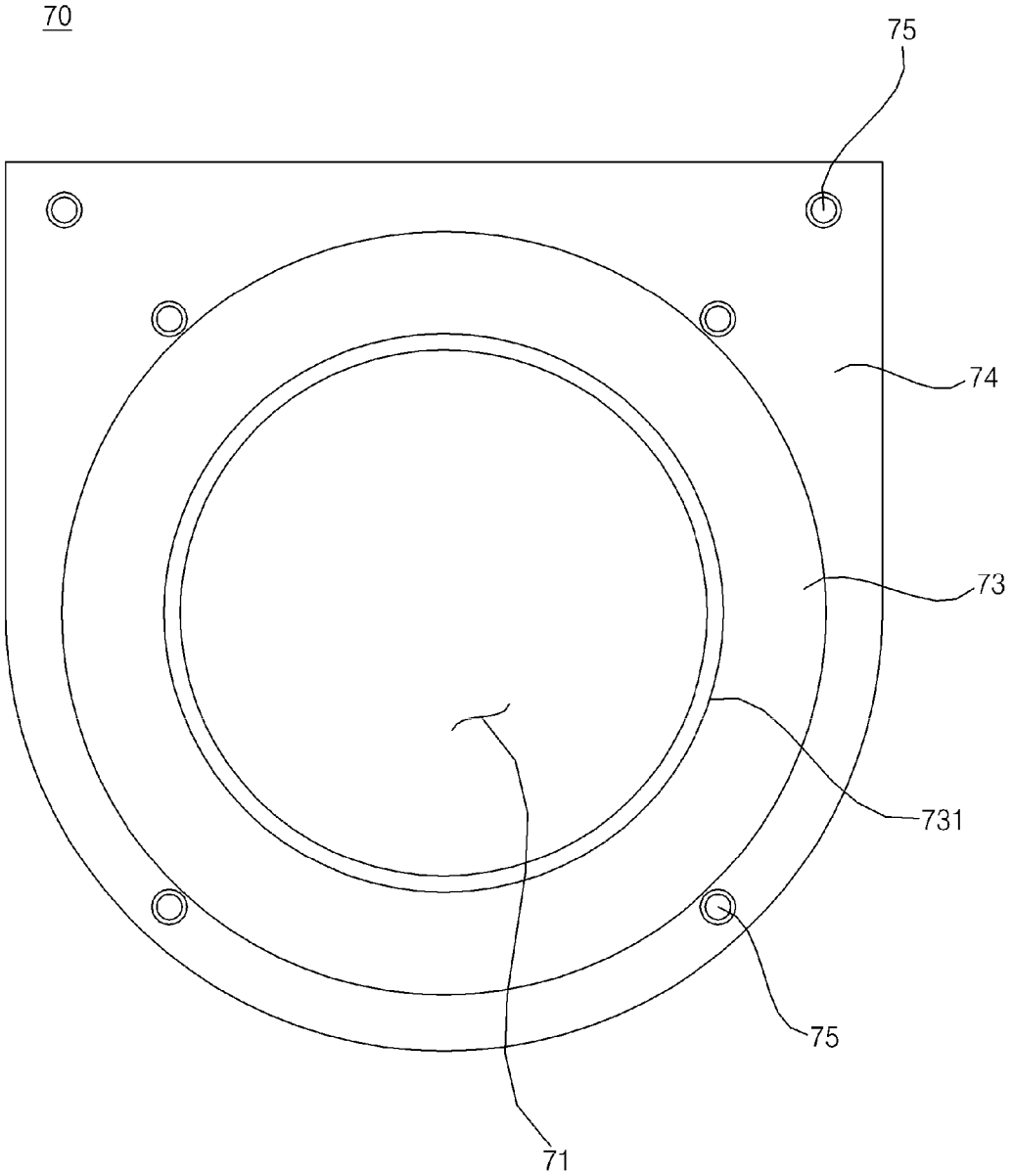
FIG. 8 is a rear view of a side cover included in the corrugated pipe forming apparatus according to an embodiment of the present disclosure.
Figure 9:
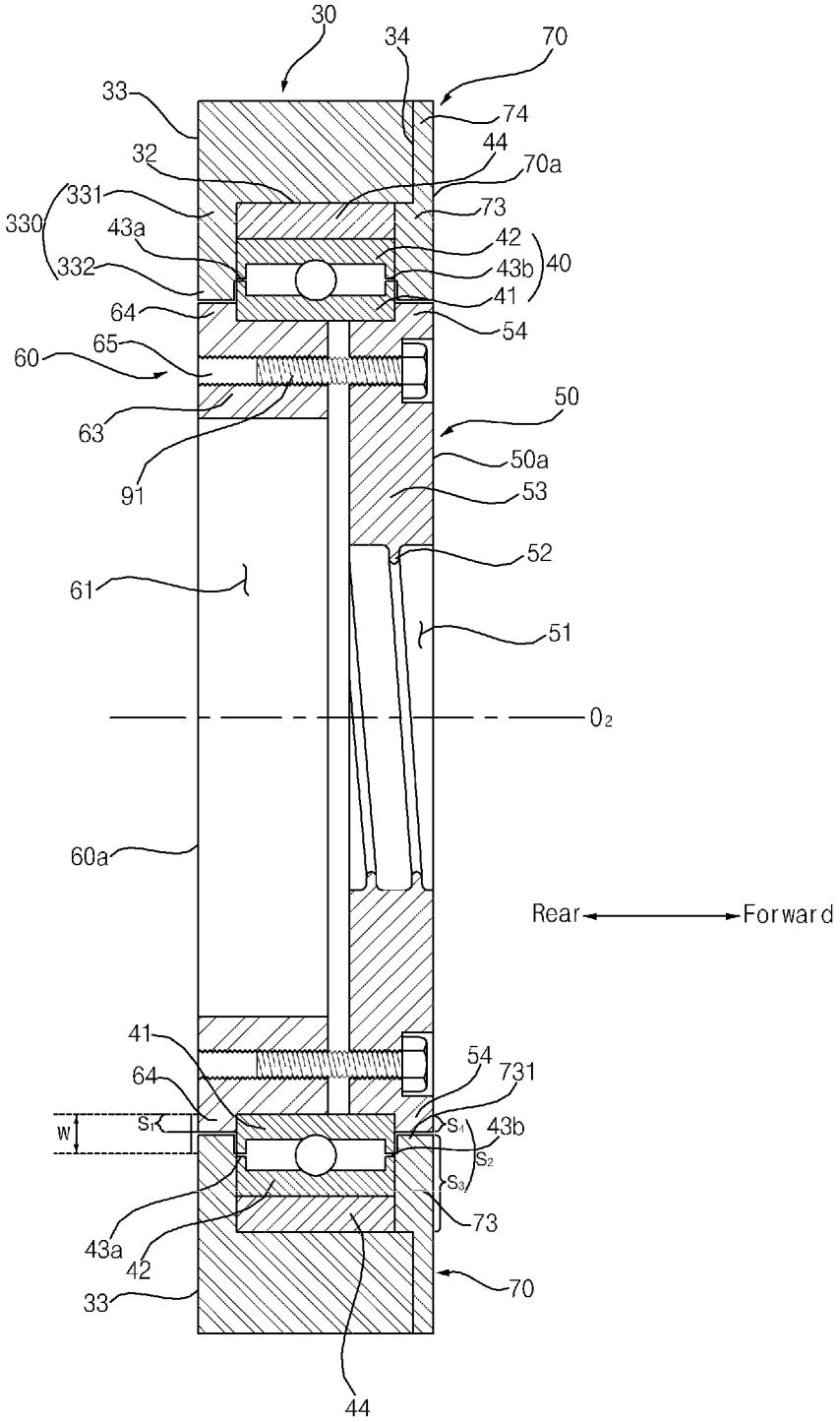
FIG. 9 is a cross-sectional view in which a support block, a dies, a fastening ring and a side cover of the corrugated pipe forming apparatus according to an embodiment of the present disclosure are assembled.
Figure 10:
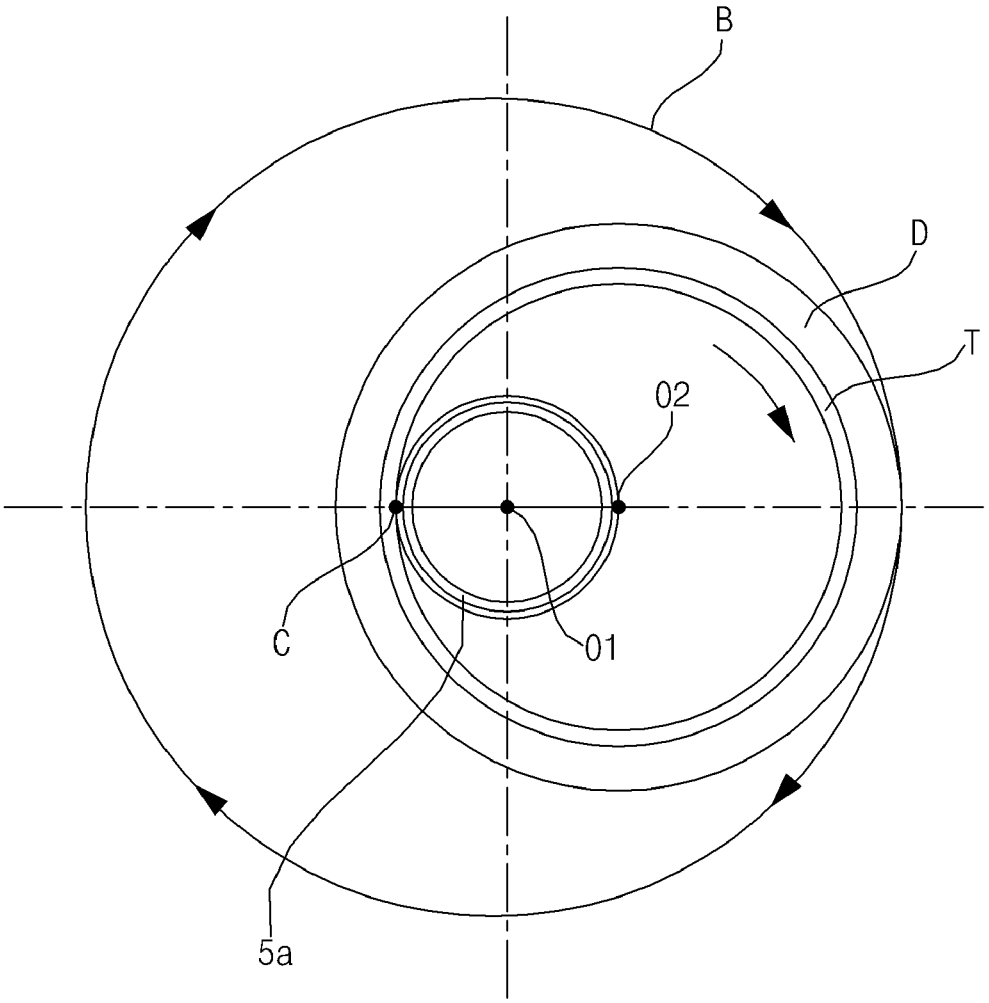
FIG. 10 is an explanatory diagram in which a valley is formed on the surface of a smooth pipe by a rotating die.

FIG. 6 is a perspective view of the dies 50, FIG. 7 is a perspective view of the fastening ring 60, FIG. 8 is a perspective view of the side cover 70, and FIG. 9 is a perspective view in which the dies 50, the fastening ring 60, and the side cover 70 are assembled to the support block 30.

Referring to FIGS. 6, 7 and 9, the dies 50 and the fastening ring 60 are disposed to face each other based on the bearing 40 and are fixedly fastened to each other with the fastening bolts 91.

Referring to FIGS. 7 and 9, the fastening ring 60 is disposed on the first lateral side 33 of the support block 30, and is formed in a ring shape having a hollow 61 through which the aforementioned smooth pipe passes, and includes a boss portion 63 inserted into an inner ring 41 and having a fastening hole 65 formed therein, and an outwardly protrusion rim 64 extending radially outward from one side of the boss portion 63.

When the boss portion 63 of the fastening ring 60 is inserted into an inner space of the inner ring 41, the outer peripheral surface of the boss portion 63 is in close contact with the inner peripheral surface of the inner ring 41, and the outwardly protrusion rim 64 is inserted into the first annular space S1 so that the front surface of the outwardly protrusion rim 64 is in close contact with a portion of the first sidewall of the inner ring 41 and is separated from the inner peripheral surface of the second shielding portion 332 of the shielding wall 330.

Accordingly, the fastening ring 60 may be rotated together with the inner ring 41 without being interfered with the shielding wall 300.

The surface of the first lateral side 33 of the support block 30 and the rear surface 60*a* of the fastening ring 60 may form a continuous same plane.

Referring to FIGS. 6 and 9, the dies 50 includes a circular hole 51 through which the aforementioned smooth pipe enters, a core portion 53 in which a screw protrusion 52 is formed on an inner peripheral surface and the inner ring 41 is inserted, and a flange portion 54 extending radially outward from the core portion 53.

In the dies 50, when the core portion 53 is inserted into the inner ring 41, the outer peripheral surface of the core portion 53 is in close contact with the inner peripheral surface of the inner ring 41, and the flange portion 54 is located in the aforementioned 2-2 annular space S4, and the rear surface of the flange portion 14 is in close contact with a portion of the second sidewall of the inner ring 41.

The dies 50 and the fastening ring 60 disposed to face each other based on the inner ring 41 are fastened to each other by fastening portion such as bolts 91, and the flange portion 54 of the dies 50 and the outwardly protrusion rim 64 of the fastening ring 60 are assembled to be pressed against the first and second sidewalls of the inner ring, respectively, so that the dies 50, the fastening ring 60, and the inner ring 41 are integrally and firmly coupled.

Referring to FIGS. 8 and 9, the side cover 70 covered on the second lateral side 34 of the support block 30 includes a plate body 74 in which an opening hole 71 is formed and is in contact with the surface of the second lateral side 34, and an inner protrusion rim 73 extending radially inward from the plate body 74 and protruding backward through the fixing ring 44 and the bearing 40.

The inner protrusion rim 73 of the side cover 70 is disposed in the 2-1 annular space S3 described above, and the plate body 74 is covered on the surface of the second lateral side 34 of the support block 30 and is fixed to the support block 30 by fastening portion such as nuts and screws inserted into the fastening hole 75.

Accordingly, the rear surface of the inner protrusion rim 73 of the side cover 70 is in contact with the entire second sidewall of the second lateral side of the fixing ring 44 and the second sidewall of the outer ring 42, and is located in front of a portion of the second sidewall of the inner ring 41. Since the second annular gap 43*b* formed between second sidewalls of the inner and outer rings 41 and 42 is shielded, the lubricating oil injected into the bearing 40 is prevented from leaking through the second gap 43*b*.

It is preferable that the inner protruding rim 73 of the side cover 70 is covered from an outer peripheral surface of the second sidewall of the inner ring 41 to ½ of a radial width W1 of the inner ring 41.

In addition, the inner protrusion rim 73 is formed so that the inner edge 731 enters slightly forward than the other parts of the inner protrusion rim 73, so that the inner edge 731 is disposed to be spaced apart from the second sidewall of the inner ring 41 so that the inner ring 41 may be rotated without interference from the side cover 70.

½ of the width in the radial direction of the second lateral wall of the inner ring 41 not covered by the side cover 70 is disposed in front of the flange portion 54 of the dies 50, and the outer peripheral surface of the flange portion is spaced apart from the inner peripheral surface of the inner edge 731 of the inner protrusion rim 73.

Accordingly, the dies 50, the fastening ring 60, and the inner ring 41 may be rotated without interference from the support block 30 and the side cover 70.

The front surface 50*a* of the dies 50 and the front surface 70*a* of the side cover 70 may form a continuous plane.

As described above, in the present disclosure, the gap 43 formed between the inner and outer rings of the bearing 40 is shielded by the shielding wall 330 formed on the first lateral side of the support block and the inner protrusion rim 73 of the side cover 70 fastened to the second lateral side of the support block 30. Hence, leakage of the lubricating oil injected into the bearing is completely prevented even when the bearing 40 rotates at a high speed, and a high-quality corrugated pipe may be continuously manufactured.

Hereinbefore, although preferred embodiments of the present disclosure have been illustrated and described, the present disclosure is not limited to the specific embodiments described above, and it goes without saying that persons having ordinary skills in the technical field to which the present disclosure pertains may implement the present disclosure by various modifications thereof without departing from gist of the present disclosure defined by the claims, and such modifications are not to be construed individually from the technical spirit and scope of the present disclosure.

DETAILED DESCRIPTION OF MAIN ELEMENTS

5*a*: smooth pipe
5*b*: corrugated pipe
20: forming barrel
30: support block
300: shielding wall
40: bearing
41: inner ring
42: outer ring
43: gap
44: fixing ring
50: dies
52: screw protrusion
60: fastening ring
70: side cover
80: forming barrel cover

What is claimed is:

1. A corrugated pipe forming apparatus comprising:

a support block rotated by power of a motor and provided with a first lateral side and a second lateral side opposite to the first lateral side, in which a circular opening is formed therein;

a bearing including an outer ring fixedly connected to an inner peripheral surface of the support block and an inner ring disposed to rotate relative to the outer ring;

a die disposed in the circular opening of the support block, in which a circular hole is formed through which a smooth pipe enters, a screw protrusion forming a valley on a surface of the smooth pipe is formed on an inner peripheral surface of the die, and at least a portion of the die is inserted into the inner ring and connected to the inner ring;

a fastening ring disposed to face the die in the circular opening of the support block and connected to the die, in which a hollow through which the smooth pipe passes is formed; and a side cover fastened to the second lateral side of the support block and having an opening hole formed therein so that a front surface of the die is exposed, wherein the support block has a shielding wall formed to protrude toward the fastening ring on the first lateral side of the support block, wherein the shielding wall is formed to cover a first gap formed between a first sidewall of the outer ring and a first sidewall of the inner ring, and wherein the side cover is formed to cover a second gap formed between a second sidewall of the outer ring and a second sidewall of the inner ring to shield the second gap.

2. The corrugated pipe forming apparatus of claim 1, further comprising a forming barrel connected to a power transmission device for transmitting the power of the motor and having a space formed therein, wherein:

the support block is disposed in the space of the forming barrel;

a screw rod is connected movably to the forming barrel; and the support block is disposed to be movable in a straight line within the space by the screw rod.

3. The corrugated pipe forming apparatus of claim 1, wherein the shielding wall protrudes radially inward to cover an entire portion of the first sidewall of the outer ring and a portion of the first sidewall of the inner ring.

4. The corrugated pipe forming apparatus of claim 3, wherein:

the shielding wall includes a first shielding portion covering the first sidewall of the outer ring and the first gap, and a second shielding portion covering the portion of the first sidewall of the inner ring; and the second shielding portion is formed to have smaller front and rear widths than the first shielding portion, and is disposed to be spaced apart from the first sidewall of the inner ring.

5. The corrugated pipe forming apparatus of claim 4, wherein the second shielding portion covers ½ of a radial width of the first sidewall of the inner ring from an outer peripheral surface of the inner ring toward a radially inner side.

6. The corrugated pipe forming apparatus of claim 1, wherein:

the fastening ring includes a boss portion inserted into an inner side of the first sidewall of the inner ring, and an outwardly protrusion rim extending in a radially outward direction from the boss portion; and the outwardly protrusion rim is in close contact with a portion of the first sidewall of the inner ring.

7. The corrugated pipe forming apparatus of claim 1, wherein:

the inner and outer rings are disposed such that the second sidewalls of the inner and outer rings opposite to the first sidewalls of the inner and outer rings enter from a surface of the second lateral side of the support block toward a first the first lateral side of the support block.

8. The corrugated pipe forming apparatus of claim 1, wherein the side cover comprises:

a plate body covering a surface of the second lateral side of the support block; and an inner protrusion rim extending radially inwardly from the plate body toward the opening hole and protruding toward the inner and outer rings to shield the second gap formed between the second sidewalls of the inner and outer rings.

9. The corrugated pipe forming apparatus of claim 8, wherein the inner protrusion rim protrudes radially inwardly so as to cover the entire portion of the second sidewall of the outer ring and a portion of the second sidewall of the inner ring.

10. The corrugated pipe forming apparatus of claim 9, wherein the inner protrusion rim protrudes to cover ½ of a radial width from an outer peripheral surface of the second sidewall of the inner ring.

11. The corrugated pipe forming apparatus of claim 9, wherein:

the inner protrusion rim is in contact with the second sidewall of the outer ring; and the inner protrusion rim is formed so that a rear surface of an inner edge enters more forward than different parts of the inner protrusion rim, so that the inner edge is spaced apart from the inner ring.

12. The corrugated pipe forming apparatus of claim 9, wherein the die comprises:

a core portion inserted into the inner ring; and a flange portion extending radially outward from the core portion, and wherein a part of the second sidewall of the inner ring not covered by the inner protrusion rim is in close contact with the flange portion of the die.

13. The corrugated pipe forming apparatus of claim 2, wherein the forming barrel is formed with a through hole connecting the space of the forming barrel and an external space, so that heat generated during forming of the corrugated pipe is radiated to an outside through the through hole.

14. The corrugated pipe forming apparatus of claim 1, wherein the support block includes a fixing ring fixedly disposed in an inner side of the inner peripheral surface of the support block for fixing the bearing.

15. The corrugated pipe forming apparatus of claim 14, wherein the fixing ring includes a bridge to which the outer ring is fixed.

16. A corrugated pipe forming apparatus comprising:

a support block rotated by power of a motor, in which a circular opening is formed therein;

a bearing including an outer ring fixedly connected to an inner peripheral surface of the support block and an inner ring disposed to rotate relative to the outer ring;

a die disposed in the circular opening of the support block, in which a circular hole is formed through which a smooth pipe enters, a screw protrusion forming a valley on a surface of the smooth pipe is formed on an inner peripheral surface of the die, and at least a portion of the die is inserted into the inner ring and connected to the inner ring; and a fastening ring disposed to face the die in the circular opening of the support block and connected to the die, in which a hollow through which the smooth pipe passes is formed, wherein the support block has a shielding wall formed to protrude toward the fastening ring on a first lateral side of the support block, wherein the shielding wall is formed to cover a first gap formed between a first sidewall of the outer ring and a first sidewall of the inner ring, wherein the shielding wall protrudes radially inward to cover an entire portion of the first sidewall of the outer ring and a portion of the first sidewall of the inner ring, wherein the shielding wall includes a first shielding portion covering the first sidewall of the outer ring and the first gap, and a second shielding portion covering the portion of the first sidewall of the inner ring, and wherein the second shielding portion is formed to have smaller front and rear widths than the first shielding portion, and is disposed to be spaced apart from the first sidewall of the inner ring.

17. A corrugated pipe forming apparatus comprising:

a support block rotated by power of a motor, in which a circular opening is formed therein;

a bearing including an outer ring fixedly connected to an inner peripheral surface of the support block and an inner ring disposed to rotate relative to the outer ring;

a die disposed in the circular opening of the support block, in which a circular hole is formed through which a smooth pipe enters, a screw protrusion forming a valley on a surface of the smooth pipe is formed on an inner peripheral surface of the die, and at least a portion of the die is inserted into the inner ring and connected to the inner ring;

a fastening ring disposed to face the die in the circular opening of the support block and connected to the die, in which a hollow through which the smooth pipe passes is formed; and a side cover fastened to a second lateral side opposite to the first lateral side of the support block and having an opening hole formed therein so that a front surface of the die is exposed, wherein the support block has a shielding wall formed to protrude toward the fastening ring on a first lateral side of the support block, wherein the shielding wall is formed to cover a first gap formed between a first sidewall of the outer ring and a first sidewall of the inner ring, and wherein the side cover comprises:

a plate body covering a surface of the second lateral side of the support block; and an inner protrusion rim extending radially inwardly from the plate body toward the opening hole and protruding toward the inner and outer rings to shield a second gap formed between second sidewalls of the inner and outer rings.

* * * * *